US007846485B2

(12) United States Patent
Blanc et al.

(10) Patent No.: US 7,846,485 B2
(45) Date of Patent: Dec. 7, 2010

(54) PACKAGING ARTICLE FOR A SUBSTANCE TO BE INFUSED

(75) Inventors: Jean Pierre Blanc, Nice (FR); Christian Ferrier, Nice (FR)

(73) Assignee: Compagnie Mediterraneenne des Cafes (SA), Carros (FR)

( * ) Notice: Subject to any disclaimer, the term of this patent is extended or adjusted under 35 U.S.C. 154(b) by 178 days.

(21) Appl. No.: 12/161,891

(22) PCT Filed: Dec. 27, 2006

(86) PCT No.: PCT/EP2006/070215

§ 371 (c)(1),
(2), (4) Date: Nov. 24, 2008

(87) PCT Pub. No.: WO2007/090485

PCT Pub. Date: Aug. 16, 2007

(65) Prior Publication Data

US 2009/0173642 A1 Jul. 9, 2009

(30) Foreign Application Priority Data

Feb. 7, 2006 (FR) ..... 06 50423

(51) Int. Cl.
*B65B 29/02* (2006.01)

(52) U.S. Cl. ..... 426/77; 99/295; 99/323; 426/432

(58) Field of Classification Search ..... 206/0.5; 99/279, 289 R, 295, 297, 323; 426/77–84, 426/112, 113, 115, 431, 433, 435, 594
See application file for complete search history.

(56) References Cited

U.S. PATENT DOCUMENTS

| | | | | | |
|---|---|---|---|---|---|
| 1,209,484 | A * | 12/1916 | Peal | 426/77 |
| 3,445,237 | A | 5/1969 | Gidge | |
| 3,446,624 | A * | 5/1969 | Luedtke | 426/77 |
| 5,170,886 | A * | 12/1992 | Holzner | 206/0.5 |
| 5,776,527 | A | 7/1998 | Blanc et al. | |
| 5,855,938 | A * | 1/1999 | Cahill et al. | 426/80 |
| 6,485,766 | B2 * | 11/2002 | Herod | 426/78 |
| 2002/0048621 | A1 * | 4/2002 | Boyd et al. | 426/77 |
| 2007/0172552 | A1 * | 7/2007 | Davies | 426/84 |
| 2007/0209524 | A1 * | 9/2007 | Kim | 99/295 |

FOREIGN PATENT DOCUMENTS

| | | |
|---|---|---|
| FR | 2 754 793 | 4/1998 |

OTHER PUBLICATIONS

International Search Report dated Mar. 27, 2007.

* cited by examiner

*Primary Examiner*—Luan K Bui
(74) *Attorney, Agent, or Firm*—Young & Thompson

(57) ABSTRACT

A packaging article for a substance to be infused, includes two layers (2, 3) of filter material enclosing a reinforcement sheet (4) equipped with a hole (5). This packaging is such that it includes a hollow cylindrical part (6) for transverse stiffening, the outer wall of which is placed on the hole (5) of the reinforcement sheet (4), and delimiting, with the layers (2, 3), a volume for receiving a substance to be infused. Application to pre-dosed packages of a substance to be infused, such as ground coffee or tea leaves.

10 Claims, 2 Drawing Sheets

PACKAGING ARTICLE FOR A SUBSTANCE TO BE INFUSED

This application is a 371 of PCT/EP2006/070215 file on Dec. 27, 2006.

This invention relates to a packaging article for a substance to be infused.

It will be used in particular for the manufacture and use of a packaging article enclosing a pre-determined dose of a substance to be infused, which may be ground coffee, tea leaves, or substances of various plant origin.

When used with a drinks making machine, the invention allows the substance in the packaging system to be infused and a beverage to be produced.

Document FR-A-2 754 793 shows packaging systems for ground coffee comprising a peripheral ring delimiting a volume to receive a substance to be infused, this volume being enclosed on the top and bottom by two sheets of filter material.

The three constituent parts render such an arrangement unsatisfactory due to its assembly. Indeed, the mechanical strength of the assembly, and in particular the peripheral joining of the sheets onto the ring, cannot be achieved effectively. Moreover, the unit is difficult to grasp as no transversal stiffness is created at the ring.

Document WO-A1-95 07041 consists of a packaging article comprising two superimposed layers of filter material and framing a sheet in reinforcing material is also known. The assembly offers a good degree of stiffness in the direction of the mating plane between the two layers of filter material. This type of packaging is also very easy to use and fits perfectly in certain drinks machines such as the one described in WO-A1-95 07041.

However, there is a need to increase the stiffness of such a packaging article perpendicular to the mating plane between the layers.

The present invention falls within this scope and for this purpose proposes a packaging system for a substance to be infused comprising two layers of filter material enclosing a reinforcing sheet equipped with a hole. This packaging system is such that it includes a hollow cylindrical part providing transversal stiffness, the outer wall of which is adjusted to fit on the hole of the reinforcing sheet, acting with the layers to define a volume for receiving a substance to be infused.

The hollow cylindrical part co-acts with the reinforcing sheet to create stiffness in the two main directions of the packaging system (mating plane direction and direction transversal to it).

This arrangement also allows the volume for receiving the substance to be infused to be adjusted very quickly without modifying the outer dimensions of the packaging article. For example, depending on the nature of the product to be infused, only the dimensions of the hole and the hollow cylindrical part need to be increased or decreased. In this case only the internal dimensions of the hollow cylindrical part need be altered.

In this way, it is possible to package any type of substance to be infused, including substances that do not need to be compressed in the volume, such as tea leaves.

It will be noted that due to the configuration of the assembly thus formed, there is no need (even if not excluded by the invention) to join the reinforcement sheet and the hollow cylindrical part in order to achieve an assembly with the desired stiffness. Indeed, the reinforcing part and the hollow cylindrical part are enclosed perfectly by the layers of filter material so that the assembly offers good cohesion.

According to preferred but non-restrictive embodiments, the invention packaging system is such that:

- the hole is circular and the hollow cylindrical part has a circular section,
- the hollow cylindrical part is formed from a rolled strip whose two ends are joined,
- the reinforcement sheet and/or the hollow cylindrical part are coated paperboard based,
- the reinforcement sheet and the layers are joined at their circumference.

The attached drawings are given as examples and are not restrictive. They show only one embodiment of the invention and will allow it to be easily understood.

Figure 4:
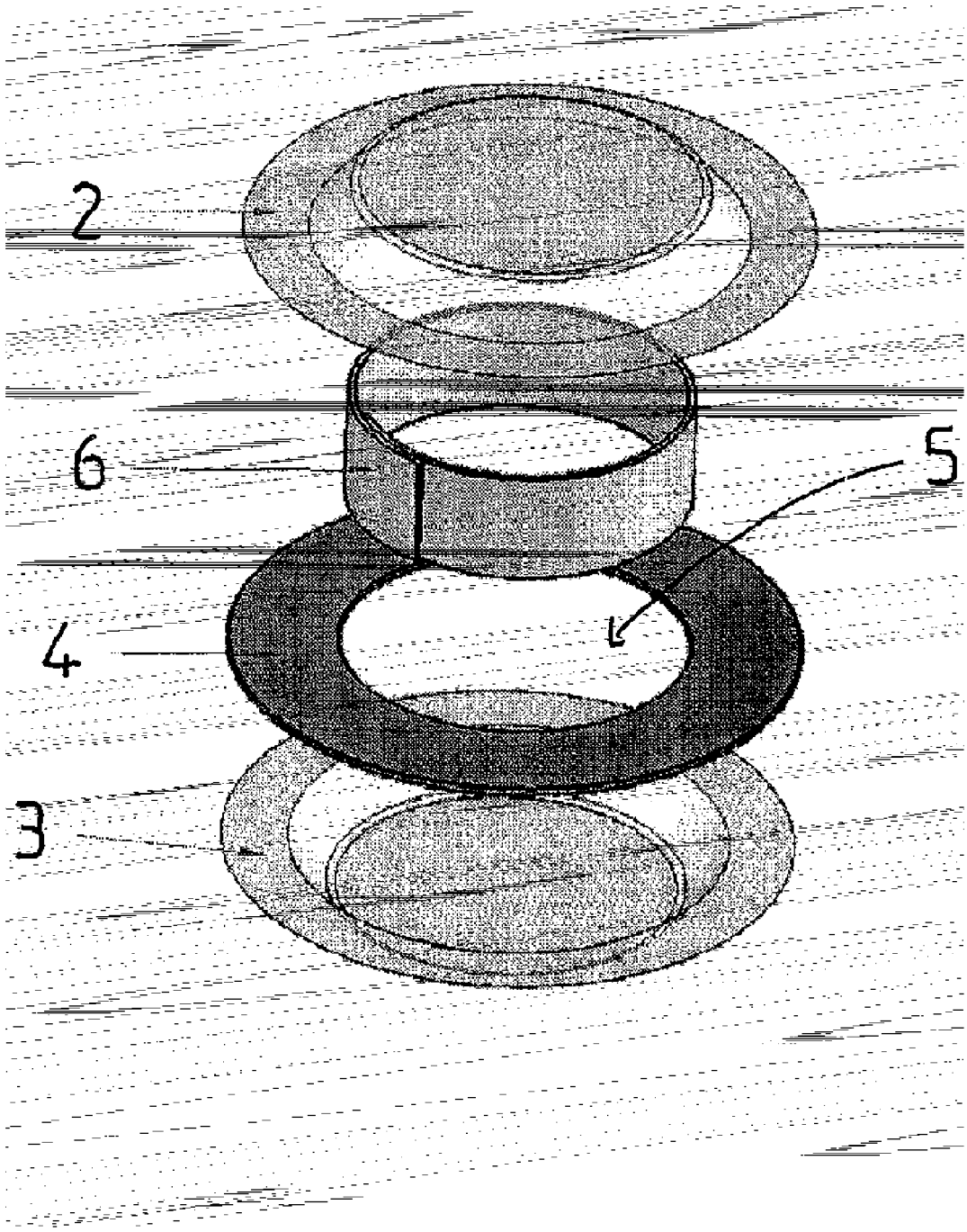

FIG. 4 an exploded view of the various components of the invention.

The drawings show a packaging system 1 roughly in the form of a capsule with an outer circular circumference of diameter D, for example about 52 mm. These dimensions and the geometrical shape of packaging 1 are not limited to this illustration. In particular, the circumference of packaging 1 can also be executed with a square or rectangular shape.

In the example shown, packaging 1 has an envelope of filter material consisting of two layers 2, 3 of filter paper assembled at their circumference 8 along a mating plane, situated appreciably in the middle of packaging article 1 in the example shown.

Between two layers 2, 3 is a reinforcement sheet 4 framed by each one of layers 2, 3 applied on one side at circumference 8. Advantageously, reinforcement sheet 4 and layers 2, 3 are assembled at circumference 8 by welding.

In a preferred embodiment, reinforcement sheet 4 is made up of paper board coated on each of its faces by a film of polymeric material.

Reinforcement sheet 4 has very good overall stiffness in the mating plane.

Sheet 4 also includes a hole 5, shown here (see FIG. 4) circular although this shape is not limitative.

A hollow cylindrical part 6 is inserted so as to fit in hole 5. The two parts can fit more or less tightly or more or less sliding according to need.

In the case shown, hollow cylindrical part 6 is a part of a cylinder with hollow circular section able to receive substance 7 to be infused. The top and bottom of hollow cylindrical part 6 are enclosed by layers 2, 3.

It is understood by the present application that the cylindrical part may have a circular section, but may also have a section of another form. Indeed, cylindrical part 6 may have a square, rectangular or other form.

In the example shown, and as can be seen on FIG. 4, hollow cylindrical part 6 is formed from a strip of appropriate material with suitable flexibility rolled so that its ends come together in order to form a ring.

Part 6 has preferably an impermeable wall so that infusion and water circulation only occur at its centre. However, other arrangements are not excluded.

During manufacture, layer 3 is first formed in a hollow, and reinforcement sheet 4 is applied on top. The hollow cylindrical part 6 is added to reinforcement sheet 4 at the same time or later. Layer 2 is then added to the assembly.

A thermal weld is then executed at the level of circumference 8 so as to join layers 2, 3 and reinforcement sheet 4. Circumference 8 constitutes a flat portion, in particular allowing packaging 1 to be centered on the production machine and/or to guide the packaging article during use.

Figure 1:
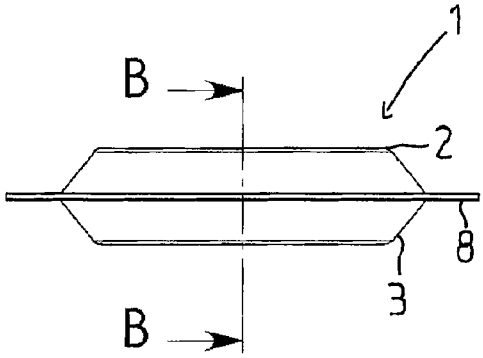
FIG. 1 is a side view of the packaging article.
Figure 2:
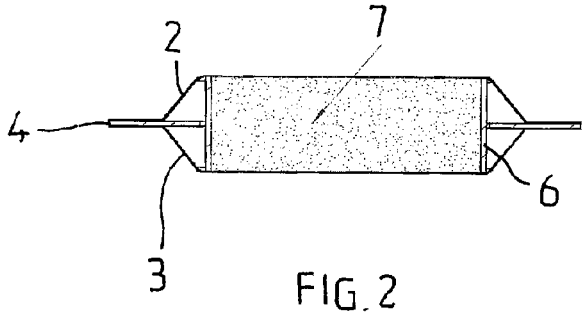
FIG. 2 is a sectional view on lines BB.
Figure 3:
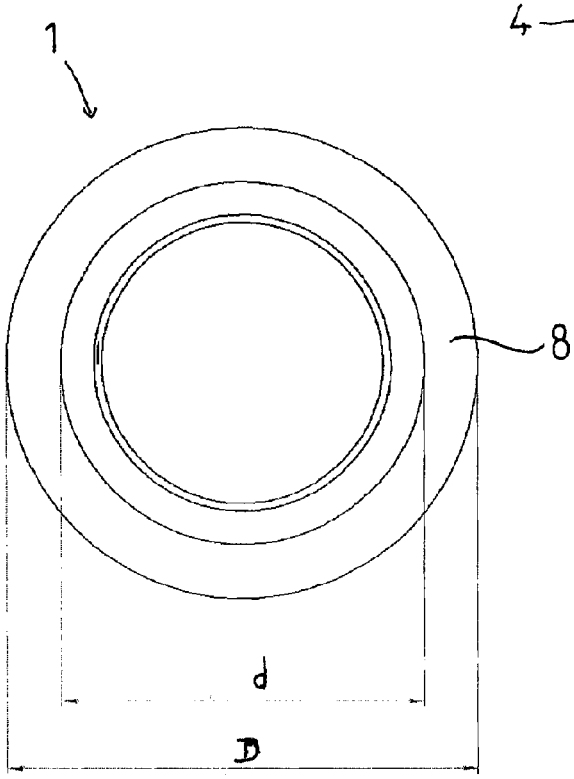
FIG. 3 is a top view of the packaging article as per this embodiment.

As an example, in the case of a circular configuration, diameter d shown on FIG. 3 shows that the internal diameter of circumference 8 is about 40 mm.

REFERENCES

1. Packaging article
2. Layer
3. Layer
4. Reinforcement sheet
5. Hole
6. Hollow cylindrical part
7. Substance to be infused
8. Circumference
D. Outer diameter
d. Inner diameter

The invention claimed is:

1. Packaging article (1) for a substance to be infused (7) comprising two layers (2, 3) of filter material enclosing a reinforcement sheet (4) equipped with a hole (5), characterized in that it comprises a hollow cylindrical part (6) for transversal stiffening, the outer wall of which is placed in the hole (5) of the reinforcement sheet (4) and layers (2, 3) enclosing a volume receiving the substance to be infused (7).

2. Packaging article (1) according to claim 1 in which the hole (5) is circular and the hollow cylindrical part (6) has a circular section.

3. Packaging article (1) according to claim 2 in which the hollow cylindrical part (6) is formed from a rolled strip whose two ends are joined together.

4. Packaging article (1) according to claim 1 in which the reinforcement sheet (4) and/or the hollow cylindrical part (6) are coated paperboard based.

5. Packaging article (1) according to claim 1 in which the reinforcement sheet (4) and layers (2, 3) are joined by their circumference (8).

6. Packaging article (1) according to claim 2 in which the reinforcement sheet (4) and/or the hollow cylindrical part (6) are coated paperboard based.

7. Packaging article (1) according to claim 3 in which the reinforcement sheet (4) and/or the hollow cylindrical part (6) are coated paperboard based.

8. Packaging article (1) according to claim 2 in which the reinforcement sheet (4) and layers (2, 3) are joined by their circumference (8).

9. Packaging article (1) according to claim 3 in which the reinforcement sheet (4) and layers (2, 3) are joined by their circumference (8).

10. Packaging article (1) according to claim 4 in which the reinforcement sheet (4) and layers (2, 3) are joined by their circumference (8).

* * * * *